United States Patent [19]

Jett

[11] 4,029,147

[45] June 14, 1977

[54] GRIPPING MEMBER FOR WELL PACKER

[75] Inventor: Marion Barney Jett, Dallas, Tex.

[73] Assignee: Dresser Industries, Inc., Dallas, Tex.

[22] Filed: Oct. 23, 1975

[21] Appl. No.: 625,355

[52] U.S. Cl. ..... 166/217
[51] Int. Cl.² ..... E21B 23/00
[58] Field of Search ..... 166/206, 216, 217, 138, 166/212, 131

[56] References Cited

UNITED STATES PATENTS

| | | | |
|---|---|---|---|
| 3,714,984 | 2/1973 | Read | 166/206 |
| 3,735,814 | 5/1973 | Tucker | 166/217 |
| 3,739,849 | 6/1973 | Merlpol | 166/216 |
| 3,818,987 | 6/1974 | Ellis | 166/216 |

*Primary Examiner*—James A. Leppink
*Attorney, Agent, or Firm*—Michael J. Caddell

[57] ABSTRACT

A unitary tubular cylindrical gripping member for well packers is disclosed having variable angled gripping teeth formed thereon and arranged to provide constant gripability of the member in well casings having different internal diameters.

5 Claims, 3 Drawing Figures

GRIPPING MEMBER FOR WELL PACKER

BACKGROUND OF THE INVENTION

The present invention relates to well packers and more specifically is directed to a unitary tubular gripping member for use in pivotable arrangement upon a well packer. A well packer utilizing a tubular gripping member was first disclosed in U.S. Pat. No. 3,548,936 to Kilgore et al. The well packer gripping slip disclosed therein utilized a generally flat tooth profile along a substantially cylindrical surface.

In U.S. Pat. No. 3,739,849 to Meripol an unitary tubular gripping member was disclosed having a curved bounding tooth profile as contrasted with the above mentioned Kilgore et al. patent having a flat bounding tooth profile. This improvement in the Meripol patent involved the versatility of the well packer utilizing such unitary slip in that with the Meripol gripping member a single packer could be utilized in casing sizes of varying internal dimensions with improved gripability of the well packer gripping member therein.

The present invention is directed to a unitary gripping member having a curved bounding tooth profile with varying angles of tooth faces according to the location of the tooth along the curved tooth profile.

DESCRIPTION OF THE PREFERRED EMBODIMENTS

Figure 1:
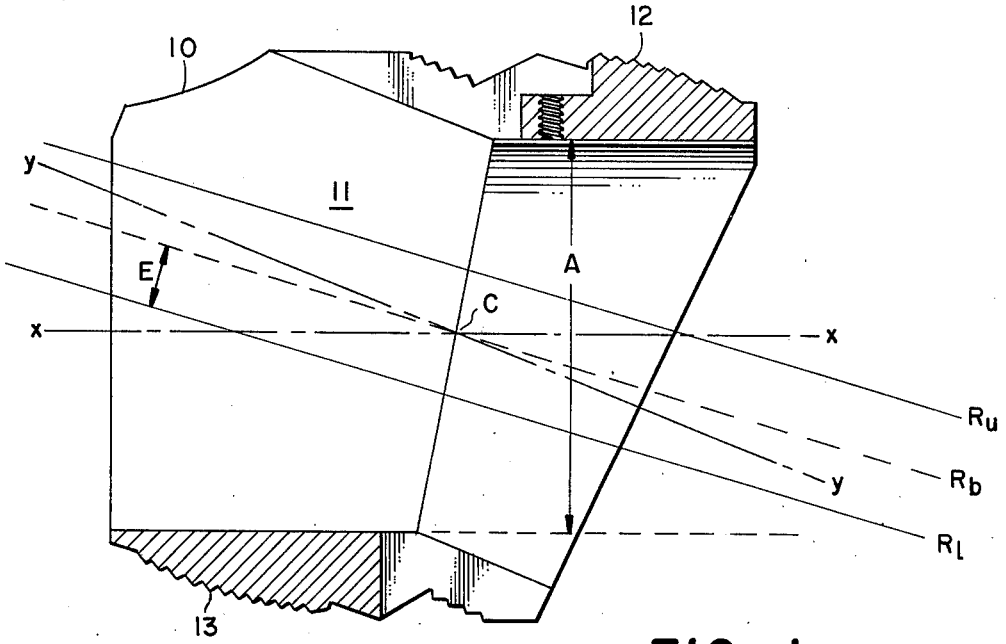
FIG. 1 is a cross-sectional side view of a tubular gripping member featuring the present invention.

FIG. 1 is a full side cross-sectional view of a unitary anchor member 10 having a generally cylindrical body with dual axial bore passage 11 passing therethrough. Bore passage 11 comprises two intersecting cylindrical bores having axes X—X and Y—Y intersecting at point C. A series of parallel peripheral ridges 12 are formed along the lower end of one side of body member 10 and diametrically opposed set of ridges or teeth 13 are formed in the upper opposite side of member 10.

Member 10 is adapted to be placed over a tubular mandrel having a general external diameter slightly smaller than the bore or bore passage X—X as shown at A. Body member 10 is adapted to partially rotate about point C on the tubular mandrel passing therethrough. The rotation of body member 10 serves to move the tooth sections 12 and 13 into and out of contact with the inner wall of a casing section containing the well packer upon which member 10 is located.

When the member 10 is oriented such that the bore passage corresponding to X—X is parallel to the packer mandrel, then teeth 12 and 13 will be in the non-contacting position in the casing. When member 10 has rotated toward a position where axis Y—Y would be in parallel configuration with the packer mandrel, teeth 12 and 13 will be moved outward into biting engagement in the casing section.

Figure 2:
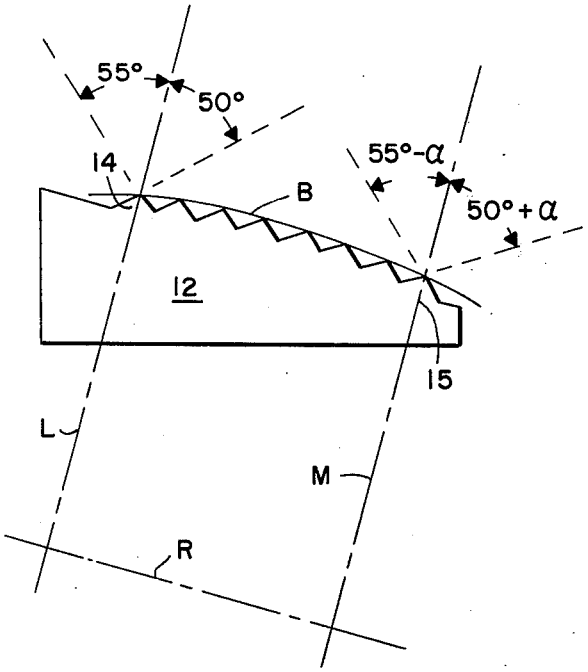
FIG. 2 is a close-up view in cross-section of a toothed portion of the member of FIG. 1.
Figure 3:
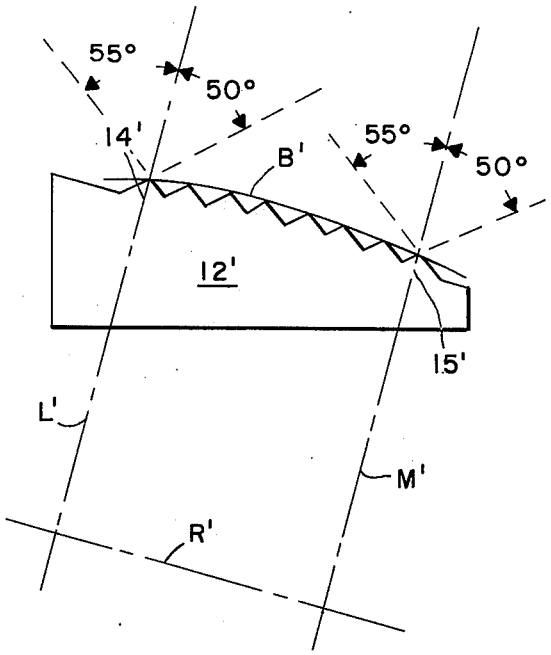
FIG. 3 is a partial cross-section of another tooth section.

Referring now to FIGS. 2 and 3, close-up sections of a tooth section 12 are illustrated. In FIG. 2 a curved line B is drawn along the tops of the teeth 12 to illustrate the curved bounding profile of the tooth section. A reference line R is constructed generally parallel to the cord of arc B to determine the angles of the individual teeth within the tooth section. Alternatively, the reference line R may be located at any angle to the cord of arc B, or the reference line may be at a measured angle to axis Y—Y. In one preferred embodiment, the reference line R was located at an angle of 5° to axis Y—Y. In FIG. 1 the base reference line through the center of rotation is denoted $R_B$. Each set of teeth on opposed sides have an offset reference line parallel to $R_B$ but offset a distance E therefrom. The upper teeth have a reference line $R_U$ and the lower teeth have reference line $R_L$. The amount of offset E depends on the difference in size between the largest and smallest casing ID's in which the gripping member will be operated.

Similarly in FIG. 3, reference line R′ is shown with respect to tooth section 12′ having curved bounding profile B′. In FIG. 3, 90° projecting lines L′ and M′ are drawn from the reference line R′ through the peaks of the uppermost and lowermost teeth. The angle that each tooth face makes with the 90° projecting lines is measured for the slip section 12′. A set of typical angles is shown in FIG. 3 wherein the uppermost face of the left hand tooth is at an angle of 50° from the projecting line L′ and the lowermost face of the tooth is at an angle of 55° from the projecting line L′.

Similarly, the lowermost tooth has an upper face at an angle of 50° from projecting line M′ and a lower face at an angle of 55° from projecting line M′. Each tooth between the uppermost and lowermost teeth has an identical angular orientation with respect to reference line R′. The result of this tooth configuration of 12′ is that when the member 10 is functioning in different internal casing diameters, such that different teeth along section 12′ are utilized for engaging the casing, each tooth in its own particular casing will contact the casing wall at a different angle than each of the other teeth in different casing diameters.

This is due to the fact that the member 10 rotates a differing amount for each internal diameter casing size. Thus the uppermost tooth would contact the smaller diameter casing and would undergo less rotation than would the lowermost tooth which contacts the greater diameter casing. Thus the gripping ability of member 10 will vary across the wide range of internal sized casings and the operator will experience some difficulty in predicting gripping forces of the packer in any particular size casing.

In FIG. 2, the tooth section 12 is shown modified according to the present invention wherein a desirable angular orientation for the faces of the uppermost tooth 14, which angles are shown at 50° and 55°, respectively, is disclosed for the upper and lower faces of tooth 14. Each succeeding lower tooth then incorporates an angular change in the upper and lower face angles, which angular change corresponds to the amount of rotation of member 10 required to project the next succeeding tooth into contact with the casing wall. Thus, from the uppermost tooth 14 to the lowermost tooth 15, the amount of angular rotation of member 10 which results in the engagement of tooth 15 rather than 14 is incorporated into the angles of the upper and lower faces, respectively, of tooth 15.

For instance, if member 10 undergoes 16° of rotation to move from a point engaging tooth 14 to a position engaging tooth 15, then the face angles of each tooth on section 12 will have to be adjusted 2° in order to spread the 16° of member rotation across the eight teeth evenly. The upper face angle of tooth 15 will be adjusted by increasing the angle an amoumt $\alpha$ equivalent to the rotation of the member required to put tooth 15 into contact with the casing wall. Likewise, the angle of the lower face of tooth 15 with respect to reference line M will be decreased by the same amount of angular rotation. Each angular tooth face will be increased or decreased an amount corresponding to the amount of rotation of member 10 required to place that particular tooth into contact with the casing wall.

Thus it can be seen from the tooth design of FIG. 2 that regardless of the size of casing in which the packer is placed, the tooth making contact with the inner casing wall will do so at the same constant angle, which angle can be predetermined by the manufacturer during the production of member 10 and which angle can be selected for maximum gripping ability within the casing. Thus the operator will know that the casing gripping member 10 will provide maximum anchoring ability within any casing he uses regardless of the casing internal diameter.

Although certain preferred embodiments of the present invention have been herein described in order to provide an understanding of the general principles of the invention, it will be appreciated that various changes and innovations can be effected in the described well packer gripping member without departing from these principles. All modifications and changes of this type are deemed to be embraced by the spirit and scope of the invention except as the same may be necessarily limited by the appended claims or reasonable equivalents thereof.

The embodiments of the invention in which an exclusive property or privilege is claimed are defined as follows:

1. A unitary tubular gripping member having an intersecting-axis bore passage therethrough and exterior gripping means thereon, said gripping means further comprising a plurality of angular teeth having a curved tooth profile, with said teeth having varying face angles according to their angular displacement from the axis intersection of said bore passage.

2. The gripping member of claim 1 wherein said angular teeth are located at opposite sides and near opposite ends of said member and each said tooth comprises a partially circumferential ridge around a portion of said member in parallel orientation to the other said teeth on the same side of said member.

3. The gripping member of claim 2 wherein each said tooth has face angles differing from those of adjacent teeth by an amount approximately equal to the amount of angular rotation experienced by said member in moving from one tooth engaging position to an adjacent tooth engaging position.

4. The gripping member of claim 3 wherein said teeth number four or more and said face angles are from 25 to 65 degrees.

5. A well tool gripping member comprising:

a tubular generally cylindrical body member having a dual intersecting-axis bore passage therethrough; and arcuate tooth means on said member along at least one side at one end thereof, said tooth means having a plurality of teeth with angular sides, each said tooth having sides of different angles than each of the other teeth with respect to said intersecting-axis bore passage.

* * * * *